US011566477B2

(12) United States Patent
Volgmann et al.

(10) Patent No.: US 11,566,477 B2
(45) Date of Patent: Jan. 31, 2023

(54) METHOD AND APPARATUS FOR TRANSFERRING ROTATIONAL OSCILLATIONS AND THERMAL ENERGY

(71) Applicant: Scientific Drilling International, Inc., Houston, TX (US)

(72) Inventors: Marco Volgmann, Braunschweig (DE); Florian Szasz, Aller (DE)

(73) Assignee: SCIENTIFIC DRILLING INTERNATIONAL, INC., Houston, TX (US)

( * ) Notice: Subject to any disclaimer, the term of this patent is extended or adjusted under 35 U.S.C. 154(b) by 79 days.

(21) Appl. No.: 17/128,030

(22) Filed: Dec. 19, 2020

(65) Prior Publication Data

US 2022/0195812 A1 Jun. 23, 2022

(51) Int. Cl.
*E21B 17/07* (2006.01)

(52) U.S. Cl.
CPC ..... *E21B 17/07* (2013.01)

(58) Field of Classification Search
CPC . E21B 17/07; F16F 15/10; F16F 15/14; F16F 2222/08
See application file for complete search history.

(56) References Cited

U.S. PATENT DOCUMENTS 11,199,242 B2 * 12/2021 Hohl ..... F16F 15/1207
2014/0151122 A1 * 6/2014 Venugopal ..... E21B 47/017 175/40
2019/0284881 A1 * 9/2019 Hohl ..... E21B 17/07

FOREIGN PATENT DOCUMENTS

WO WO-2021202484 A1 * 10/2021

* cited by examiner

*Primary Examiner* — Matthew R Buck
(74) *Attorney, Agent, or Firm* — Ewing & Jones, PLLC

(57) ABSTRACT

A damping device for use with a downhole tool having a tool axis and an expected operational temperature range, may comprise a device housing mechanically coupled to the tool and including a volume; and an inertia element movably supported in the receptacle and having a volume, a mass, and a non-zero moment of inertia about the tool axis. The inertia element may be supported within the receptacle such that the inertia element can move relative to the device housing and an interface between the device housing and the tool may include an area-altering feature. The device housing has a coefficient of thermal expansion that allows the interface to transmit a predetermined amount of torque and a predetermined amount heat across at expected operational temperatures. The interface may include a thermally conductive material in thermal contact with the device housing and the tool.

12 Claims, 16 Drawing Sheets

METHOD AND APPARATUS FOR TRANSFERRING ROTATIONAL OSCILLATIONS AND THERMAL ENERGY

CROSS REFERENCE TO RELATED APPLICATIONS

None.

TECHNICAL FIELD/FIELD OF THE DISCLOSURE

The present disclosure relates generally to damping vibrations or rotational oscillations during drilling operations using typical drilling system, such as rotary steerable systems, and specifically to inertial damping systems converting vibration energy into heat energy, resulting in the desired damping effect.

BACKGROUND OF THE DISCLOSURE

In hydrocarbon drilling operations, boreholes are typically drilled by rotating a drill bit attached to the end of a drill string. The drill bit can be rotated by rotating the drill string at the surface and/or by a fluid-driven downhole mud motor, which may be part of a bottom hole assembly (BHA). For example, a mud motor may be used for directional drilling operations when used in conjunction with measurement while drilling (MWD) and/or logging while drilling (LWD) components. The combination of forces and moments applied by the drill string and/or mud motor and forces and moments resulting from the interaction of the drill bit with the formation can have undesirable effects on the drilling system, including reducing the effectiveness of the cutting action, damage to BHA components, reduction in BHA components life, and interference in measuring various drilling parameters.

SUMMARY

To mitigate such negative effects, a BHA may be equipped with one or more damping system to absorb vibration energy from the BHA and thereby damping the effects associated with cyclical rotational accelerations (rotational vibration).

A damping device for use with a downhole tool adapted to rotate about a tool axis, may comprise a device housing mechanically coupled to the downhole tool. The housing may comprise an annular wall having a central bore therethrough, the device housing may include a receptacle having a volume and an inner surface, and an inertia element may be movably supported in the receptacle. The inertia element may have a volume, a mass, and a non-zero moment of inertia about the tool axis. The volume of the inertia element may be less than the volume of the receptacle so that an interstitial volume may be defined between the inertia element and the receptacle. The interstitial volume may be occupied by a fluid or an elastomer. The inertia element may be supported within the receptacle in a manner that allows the inertia element to move relative to the device housing. The device housing may be configured as a cartridge that is mechanically coupled to a downhole tool. The device housing and the downhole tool may be configured such that rotational vibration and rotational acceleration of the downhole tool are transferred via the mechanical coupling. In some instances, the mechanical coupling may be a shaft-hub joint such as a common form-locked, press fit, and/or force-locked connection.

The device may further include a pressure compensation device. The pressure compensation device may comprise a pressure compensation housing and a piston moveably mounted therein so as to define a variable compensation volume, and the variable compensation volume may be in fluid communication with the receptacle. The device may further include at least one axial bearing and at least one radial bearing, or a combined axial and radial bearing, each bearing positioned between the inertia element and the inner surface of the receptacle.

The device may further include, positioned between the inertia element and the inner surface of the receptacle, at least one of a longitudinal biasing means and longitudinal friction pad combination or a radial biasing means and radial friction pad combination.

The pressure compensation housing may be formed separately from the device housing and the pressure compensation housing may both be received within the device housing. Alternatively, the pressure compensation housing may comprise the device housing.

The device may include at least one of a longitudinal bearing and a radial bearing or a combined axial and radial bearing, positioned between the inertia element and the inner surface of the receptacle and, positioned between the inertia element and the inner surface of the receptacle, at least one of a longitudinal biasing means and longitudinal friction pad combination or a radial biasing means and radial friction pad combination.

The device housing and receptacle may be configured such that movement of the inertia element relative to the device housing can comprise rotation through 360 degrees about the tool axis. The device housing may comprise a collar configured to be part of a drill string or the device housing may be affixed to a collar or downhole tool, which collar or downhole tool may be affixed to or integral with a drill collar and/or a drill bit.

The inertia element may have an outer radius less than the outer radius of the housing, the inertia element may have an inner radius substantially equal to the radius of the central bore, and the receptacle may be in fluid communication with the central bore. Alternatively, the inertia element may have an outer radius substantially equal to the outer radius of the housing, the inertia element may have an inner radius greater than the radius of the central bore, and the receptacle may be in fluid communication with the environment surrounding the housing.

The inertia element may have a shape selected from the group consisting of square toroids, tori, and azimuthally-spaced segments.

A method for providing a tool for use with a bottomhole assembly (BHA), the tool including a damping device. The damping device may include an inertia element and a damping fluid in contact with the inertia element. The damping device may be mechanically coupled to and define a clearance with an adjacent member. The method may comprise the steps of:

a. calculating a set of natural frequencies and mode shapes of the BHA based on the mechanical properties of the BHA;
b. selecting at least one desired frequency from the calculated natural frequencies;
c. calculating or measuring the frequency dependent damping response of a damping device and adjusting at least one property of the damping device so that the calculated or measured frequency dependent damping response corresponds to the at least one desired frequency;

d. using the calculated mode shapes to determine where to couple the damping device to the BHA; and e. using the calculated frequency-dependent damping response to configure the damping device such that the clearance is the smallest clearance that achieves a predetermined amount of torque transmission at the expected operational temperature range.

The method may include configuring the tool such that at an expected operational temperature, a friction interface exists between the damping device and the adjacent member. Step e) may include configuring the damping device such that the friction interface has a predetermined operational coefficient of static friction at the expected operational temperature.

A method for optimizing a downhole damping device for use with a bottom hole assembly (BHA). The damping device may have a longitudinal axis and may include an inertia element and a damping fluid or elastomer in contact with the inertia element. The damping device may be mechanically coupled to the bottom hole assembly (BHA) and may define at least one mechanical interface therewith. The method may comprise the steps of:

a) calculating a set of natural frequencies and mode shapes for the BHA based on the mechanical properties of the BHA;

b) selecting at least one desired frequency from the calculated natural frequencies;

c) calculating or measuring the frequency-dependent damping response of the damping device and adjusting at least one property of the damping device so that the calculated or measured frequency-dependent damping response corresponds to the at least one desired frequency;

d) using the calculated mode shapes to determine where to couple the damping device to the BHA; and e) using the calculated accelerations to configure the device housing such that at the expected operational temperature range the mechanical interface has a predetermined coefficient of static friction.

The method may further include the steps of calculating, for at least a selected natural frequency of the BHA, the amplitude of vibration for each point along the BHA, identifying at least one location on the BHA at which amplitude of vibration at the selected natural frequency has a zero value and positioning the damping tool at the identified location. The BHA may comprise a drill bit.

Step c) may comprise adjusting one or more properties selected from the group consisting of the mass of the inertia element, material density of the inertia element, moment of inertia of the inertia element to the longitudinal axis, shape of the inertia element, shape of the tool, density of the damping fluid, and viscosity of the damping fluid, and selecting a value that results in a damping tool frequency that most closely matches the desired frequency. The mode shapes may correspond to a calculated amplitude of vibration at each point along the tool and may include nodes and antinodes. Step d) may include positioning a damping device at one or more antinodes.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
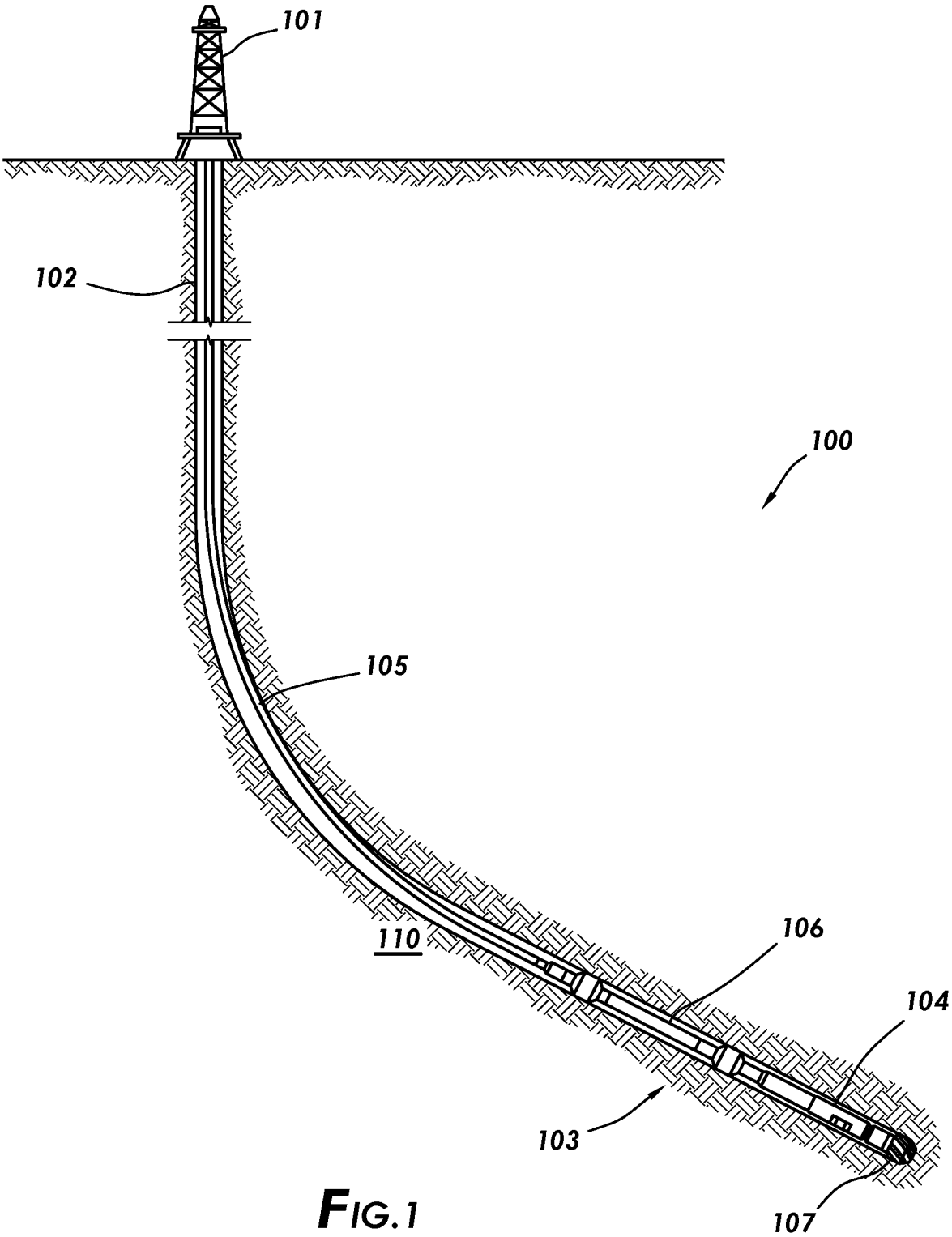
FIG. 1 is a schematic view of a drilling system in which embodiments of the current invention can be used.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

The present disclosure hereby includes the concepts and features described in US. Application Ser. No. 62/952,233, filed Dec. 21, 2019 and entitled "Method and Apparatus for Damping/Absorbing Rotational Vibrations/Oscillations," and US. Application Ser. No. 62/976,898, filed Feb. 14, 2020 and entitled "Method and Apparatus for Damping/Absorbing Rotational Vibrations/Oscillations," each of which is hereby incorporated herein in its entirety.

Referring initially to FIG. 1, a drilling system 100 in which the present apparatus may be used may include a drilling rig 101 positioned above a wellbore 102 that extends into a subsurface formation 110. A drill string 105 may extend from drilling rig 101 into wellbore 102 and may terminate in a bottom hole assembly (BHA) 103. Drill string 105 may be driven by the surface equipment of the rig. In some embodiments, BHA 103 may include a drill bit 107, a motor 106, which may be a mud motor or other downhole motor, and a steerable system 104, which may be a rotary steerable system (RSS). BHA 103 may optionally include various other devices, such as logging or measurement devices, communications devices, and the like. If present, steerable system 104 may be used to steer the bit as the wellbore is drilled. The rotational force (torque) required to rotate drill bit 107 can be provided a torque creating or applying apparatus, which may be a drill string 105, motor 106, or a combination thereof.

Figure 2:
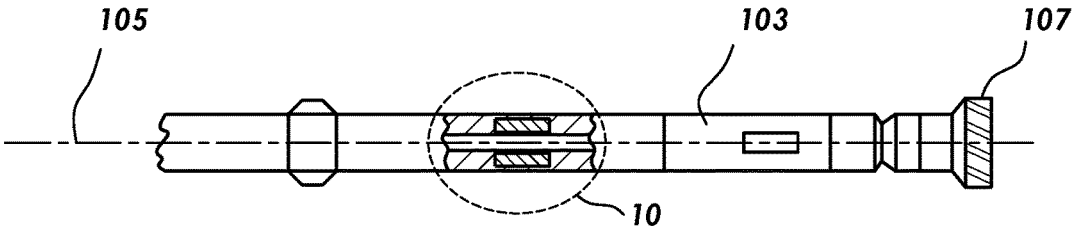
FIG. 2-4 schematically illustrate possible locations for a damping device and its different setups for installation in a drilling system.
Figure 3:
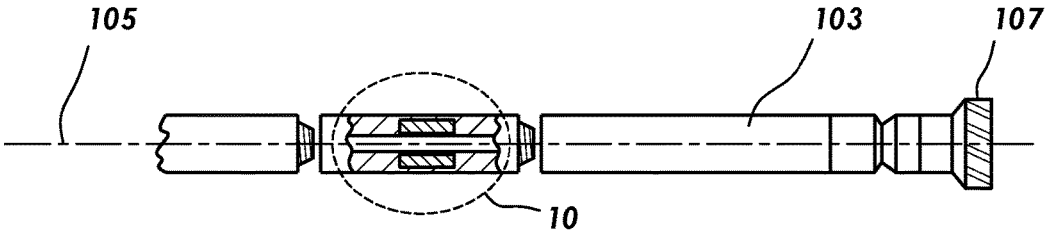
Figure 4:
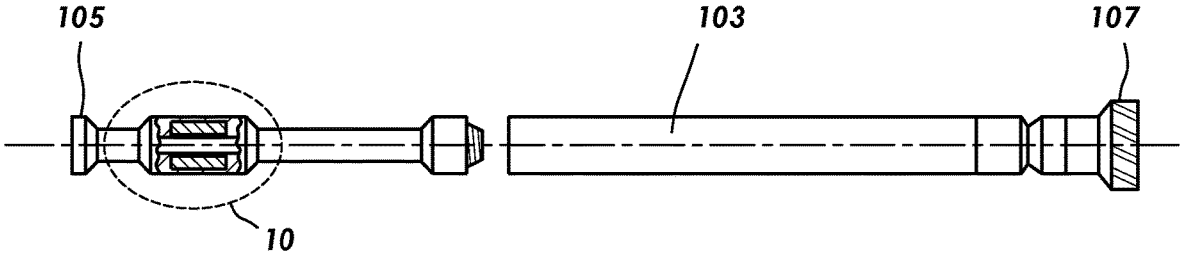

According to FIGS. 2-4, in some embodiments, one or more damping devices 10 may be positioned between the torque applying or creating apparatus and drill bit 107. By way of example only, a damping device 10 may be positioned between drill string 105 and drill bit 107 or between steerable system 104 and drill bit 107. Alternatively or additionally, a damping device may be part of the drill bit 107. In FIG. 2, damping device 10 is integrated in BHA 103. In FIG. 3, damping device 10 is provided on one or more standalone subs as an add-on to BHA 103. FIG. 3 shows a "modular" device, in which the functional features can be selectively added or removed at a rigsite. FIG. 4 shows a setup in which the functional features are integrated into a different component of the BHA (e.g. a stabilizer or a flex sub). If the damping device is included (integrated) in the BHA, adding or removing the damping device at the rigsite is only possible if the entire BHA component is added or removed. The optimal position of the damping device depends on a multitude of parameters. Optimal efficacy is reached when placed at an anti-node of the respective modal-shape.

Figure 5:
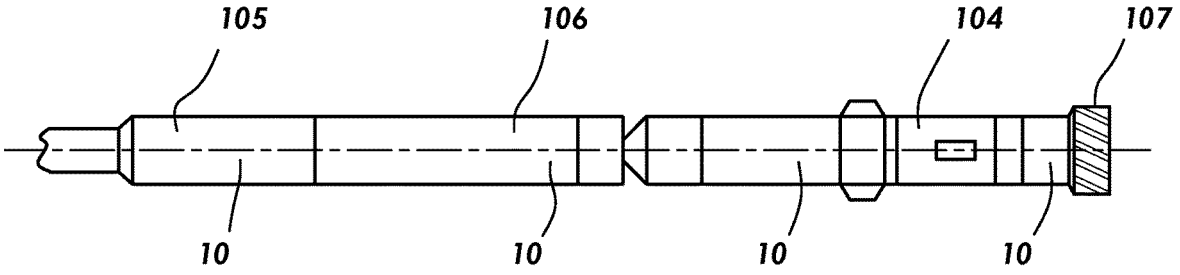
FIGS. 5-7 schematically illustrate possible locations for a damping device and its different setups for installation in a drilling system.
Figure 6:
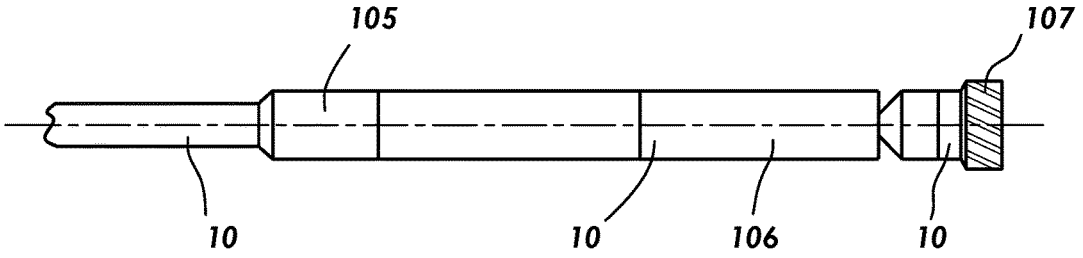
Figure 7:
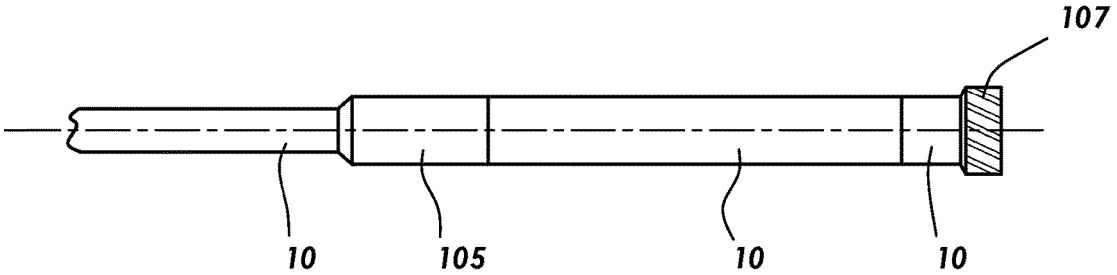

The damping device may be part of any BHA component. FIGS. 5-7 show various possible locations for the damping device 10 in the drill string. Specifically, FIG. 5 shows several possible locations for the damping device 10 on a motor driven RSS BHA. FIG. 6 shows several possible locations for damping device 10 on a conventional motor driven BHA. FIG. 7 shows several possible locations for damping device 10 on a conventional BHA without motor and RSS.

Figure 8:
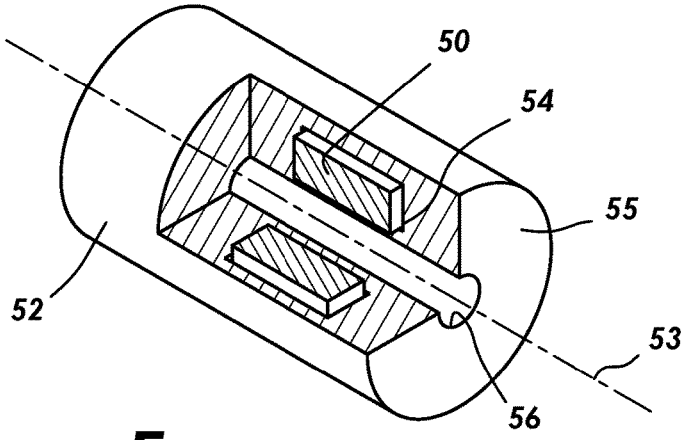
FIG. 8 is a cut-away view of a device in accordance with an embodiment of the invention.

Referring now to FIG. 8, some embodiments of damping device 10 comprise a housing 52, a receptacle 54 defined within housing 52, and at least one component with significant rotational inertia, illustrated as inertia element 50, disposed in receptacle 54. As used herein, "rotational inertia" refers to the tendency of an element to resist rotation. In some cases, the rotational inertia of inertia element 50 should be as great as possible. In order to be effective, inertia element 50 has certain minimum desired inertia. The minimum desired inertia depends on the energy to be dissipated and can be adapted to the specific application.

In some embodiments, housing 52 may include an annular housing wall 55 defining a coaxial bore 56 and a coaxial cylindrical surface, which may serve as a fluid passage. The thickness of housing wall 55 is a matter of design preference and depends in part on the magnitude of drilling loads (torque, bending, etc.) that are expected to be conducted through either the housing or the receptacle. Inertia element 50 can be any annular or non-annular shape having a non-zero moment of inertia about the longitudinal (rotational) axis 53 of the drill string. By way of example, inertia element 50 may be a square toroid (as illustrated), a torus, a plurality of azimuthally-spaced segments, or other distribution of mass within housing 52. The total mass of inertia element 50 may be evenly distributed or substantially evenly distributed about axis 53.

As discussed above, damping device 10 may be positioned on a component of the BHA or mechanically coupled to a downhole tool. In other embodiments, damping device 10 may be integral with a BHA component. In some embodiments, housing 52 may lack a bore 56, but in embodiments in which the damping device 10 (and therefore housing 52) are integral with a BHA component the bore 56 will most likely be required and will serve as a fluid passage. More than one damping device 10 may be placed at one location on a component of the BHA and damping devices 10 may be placed at more than one location on a BHA. Each of the plurality of devices may provide different damping. The devices may be similar except for their fluids and/or the inertia elements.

Figure 9:
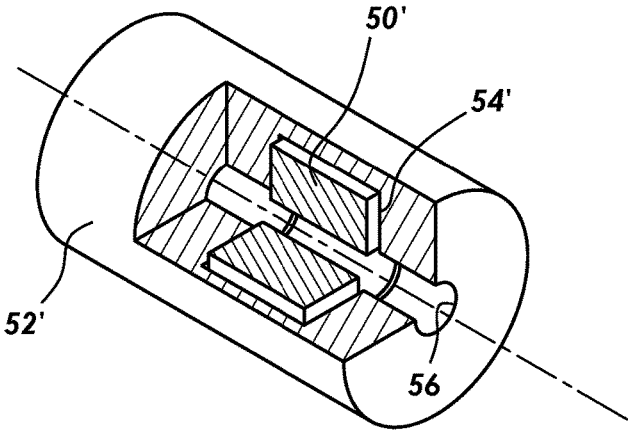
FIG. 9-10 illustrate alternative embodiments of the device of FIG. 8.
Figure 10:
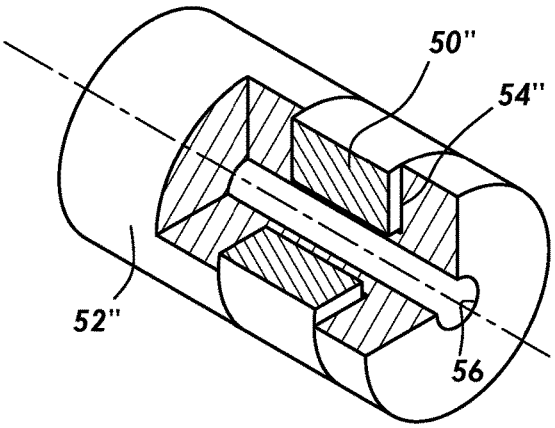

Referring briefly to FIGS. 9-10, housing 52 and the position of inertia element 50 therein may have any suitable configuration, including but not limited to the embodiments shown at 52, 52', and 52", in which receptacles 54, 54', and 54", respectively, have different configurations.

Receptacle 54 is configured such that the volume of receptacle 54 is greater than the volume of inertia element 50 and defines an interstitial volume therewith. As set out in detail below, the interstitial volume, i.e., the volume of receptacle 54 that is not occupied by inertia element 50, may be filled with one or more fluids and/or elastomers.

Figure 11:
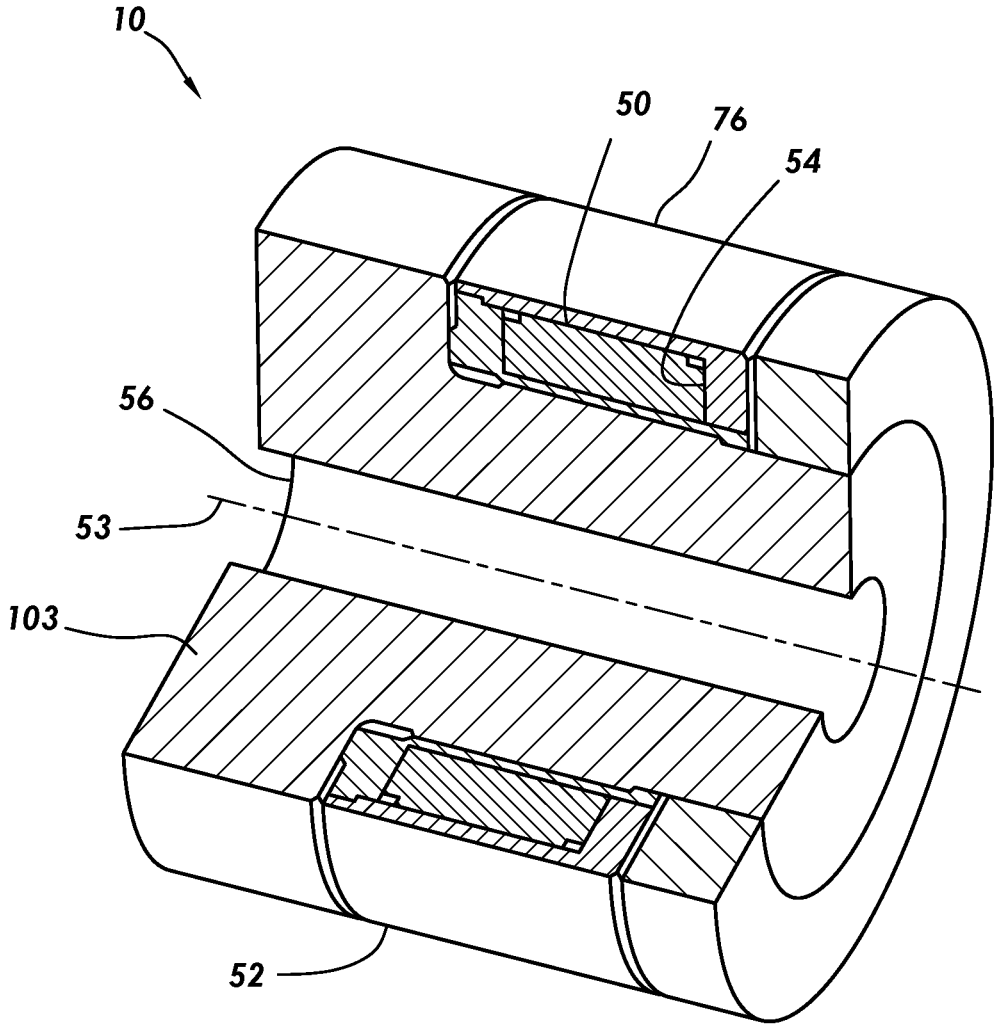
FIG. 11 is a cut-away view of a device in accordance with another embodiment of the invention.
Figure 12:
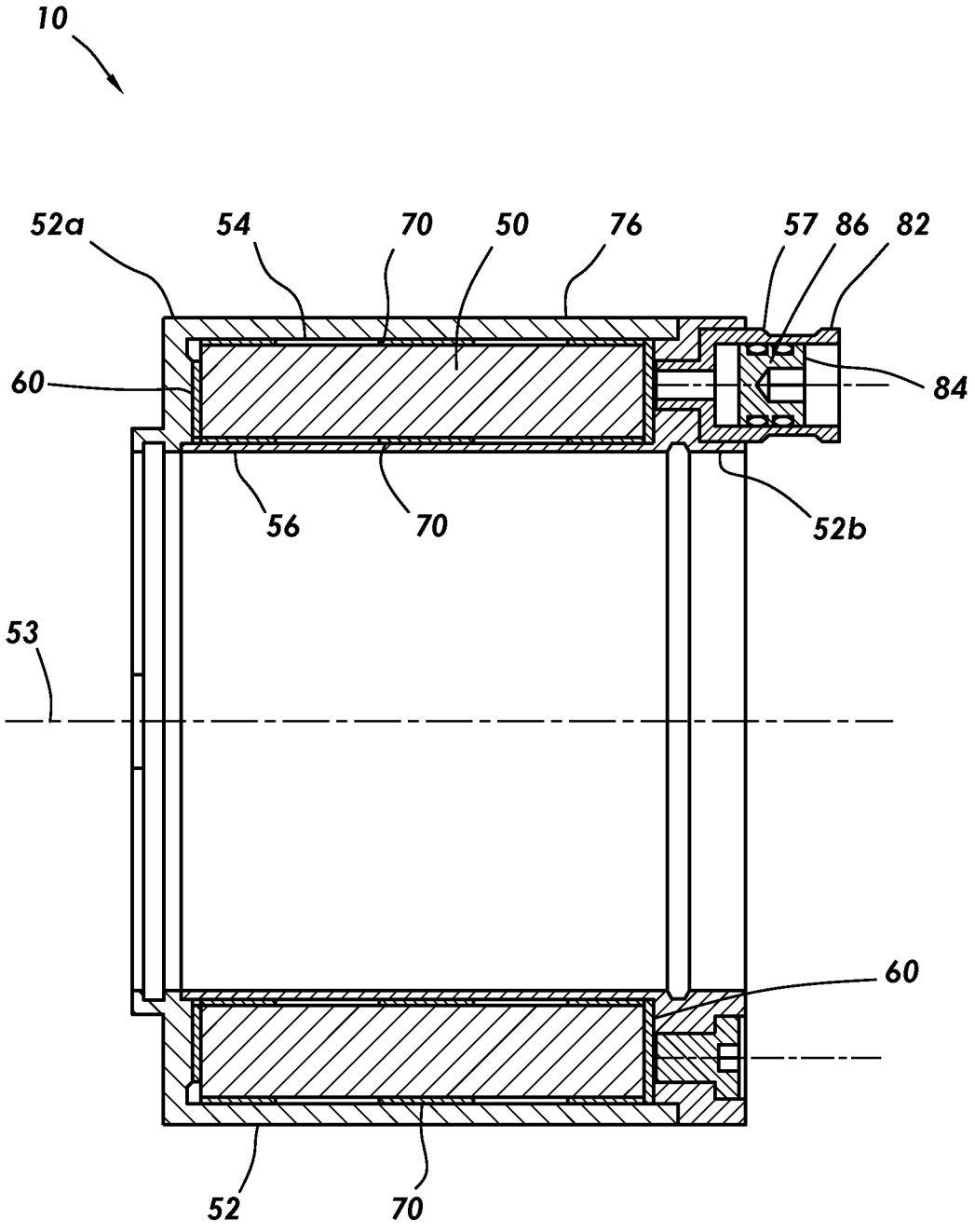
FIG. 12 is a cross-section illustrating one component of the embodiment of FIG. 11.

Referring now to FIGS. 11 and 12, in an alternative embodiment, inertia element 50 may be housed in a cartridge 76, which comprises the housing 52. If a cartridge 76 is present, the interior of the cartridge defines receptacle 54. In such embodiments, cartridge 76 and thereby the damping device 10 may be mechanically coupled to a component of the BHA, for instance by a common form-locked, such as a spline shaft connection and/or a common force-locked connection, such as a press fit between bore 56 and a through-going shaft or between a cylindrical surface of the cartridge 76 and a coaxial bore in said component of the BHA, or the like. In some embodiments, cartridge 76 may be configured to be easily removed or replaced and/or to allow easy access to the cartridge and to the contents of the cartridge. As discussed above, if present cartridge 76 may be mechanically coupled to a component of the BHA or otherwise mounted so as to transmit rotational vibrations and/or accelerations from the drill string 105 to the cartridge 76 and thereby to the contents of the cartridge 76, such as the inertia element 50 and a fluid contained in receptacle 54. In such alternative embodiment the functional capability of the damping device 10 is dependent on the mechanical coupling. To ensure operational capability of the damping device 10 the tolerance of the mechanical coupling needs to be adjusted to the intended operating point of the damping device 10, as described below.

In some embodiments, since the device is subject to well bore conditions, the fluid pressure in receptacle 54 may be adjusted to the pressure in the well bore using an optional pressure compensation feature 57. If present, pressure compensation feature 57 may be part of or attached to cartridge 76. FIG. 12 illustrates an exemplary embodiment in which a pressure compensation feature 57 comprises a compensation piston housing 82 having compensation piston 84 moveably mounted therein. Together, compensation piston housing 82 and compensation piston 84 define a variable compensation volume 86. Compensation piston 84 may or may not be equipped with a biasing means that tends to reduce the volume of compensation volume 86. Compensation volume 86 may be in fluid communication with receptacle 54 and thus filled with the same fluid as the interstitial volume. Movement of compensation piston 84 inside compensation piston housing 82 adjusts compensation volume 86 to achieve a pressure equilibrium between fluid in the well bore and fluid inside damping device 10. In an alternative embodiment (not illustrated) the pressure compensation feature 57 may comprise one or more corrugated bellows defining a variable compensation volume 86, and which corrugated bellows may be equipped with or may be a biasing means themselves.

The embodiment of FIG. 12 also includes a two-part housing 52, comprising an outer housing 52*a* and an inner housing 52*b*. Housing 52 may comprise a single element or may comprise an assembly of two or more parts, which may be, by way of example only, welded together.

In some embodiments, inertia element 50 can be supported within receptacle 54 in a manner that allows inertia element 50 to rotate about axis 53 without contacting the walls of receptacle 54. The support for inertia element 50 may optionally include longitudinal bearings 60 and/or radial bearings 70 or one or more combined axial and radial bearings 80 (FIG. 15), in addition to a fluid. Longitudinal bearings 60 may be positioned between the end(s) of inertial element 50 and the inner surface of receptacle 54. Radial bearings 70 may be positioned between the inside and/or outside of inertial element 50 and the inner surface of receptacle 54. Bearings 60, 70 can be sliding bearings or roller bearings. If present, axial and/or radial bearings 60, 70 can be configured such that inertia element 50 rotates around the centerline of the damping device 10. In some embodiments, inertia element 50 is disposed in housing 52 in a manner that allows at least some rotation of inertia element 50 about axis 53 relative to housing 52. In some embodiments, rotation of inertia element 50 about axis 53 is not restricted; in such embodiments, it is possible for inertia element 50 to rotate through 360 degrees.

If present, axial and/or radial bearings 60, 70 can also be configured such that a certain predetermined gap between housing and inertia ring is maintained. One function of bearings 60, 70 is to maintain a substantially uniform circumferential gap by preventing inertia element 50 from coming into contact with the inner surface of receptacle 54. A second function is functional separation. In preferred embodiments the friction is generated primarily within the fluid, which is free from wear, deterioration and undesired properties. In some alternative embodiments (e.g. FIGS. 19 & 20) bearings 60, 70 may be similar to friction pads (discussed in detail below) and may serve both purposes (separation and friction) simultaneously.

In some embodiments (not shown), instead of being provided in conjunction with cartridge 76, pressure compensation feature 57 may be incorporated into or formed as part of housing 52. In these embodiments, compensation piston housing 82 and device housing 52 may be a single element and fluid communication between the wellbore and the back side of compensation piston 84 may comprise a fluid channel extending through a portion of housing 52, such as housing wall 55.

Relative movement between inertia element 50 and drill string 105 is partially restricted by friction generated as inertia element 50 moves within receptacle 54. As a result, some of the kinetic energy of the drill string 105 is dissipated as heat. Because of the transformation of kinetic energy into heat, the fluid and/or the inertia element 50 disposed in receptacle 54 may expand, thereby increasing the pressure inside receptacle 54. In some embodiments, housing 52 may contain the pressure and in some embodiments pressure compensation feature 57 may be used to maintain a desired fluid pressure in receptacle 54.

As discussed above, if present, cartridge 76 may be mechanically coupled to a component of the BHA. The mechanical coupling may need to be adjusted to the intended operating point of the damping device 10, as described below. In addition to the mechanical coupling, the cartridge 76 may also be thermally coupled to the BHA component. Depending on the thermal conductance of the coupling, the coupling may serve as an additional path for removing the generated heat from the damping device 10 via the BHA component. From the BHA, heat may be conducted into the drilling fluid in the one or more bores in said BHA component serving as fluid passage towards the bottom end of the drill string 105.

In some embodiments, the thermal conductance of the coupling may, for instance, be adjusted by resizing the contact surface within the coupling, including a thermally conductive material in between the surfaces, or the like.

The thermal conductivity between the damping device 10 and the BHA can be adjusted by various modifications to the interface therebetween. For example, the interface may include one or more area-altering features and/or a heat-transfer coating or fluid (not shown) may be included at the interface. As used herein, "area-altering feature" refers to any modification to an interface between two components that alters the surface area at which the components are in direct or indirect contact from the general geometrical area of the interface. By way of example, the general geometrical area of the interface may be a right cylinder and the surface area of the interface may be altered by including dimples, pleats, grooves, serrations, or fins thereon. An example of an area-decreasing embodiment might include a serration with a reduced number of teeth and/or a decreased overlap (contact ratio) of the individual pairs of teeth. In some embodiments, area-altering features may be provided on the contact surfaces of both components such that the respective features correspond and align so as to increase thermal contact therebetween.

Figure 13:
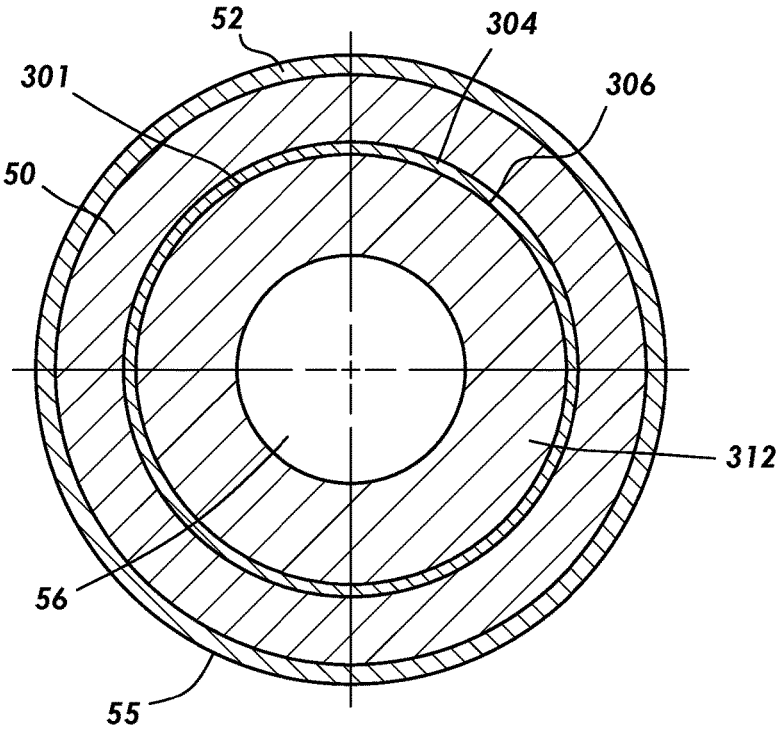
FIG. 13 is a schematic cross-section illustrating another embodiment of the invention.
Figure 14:
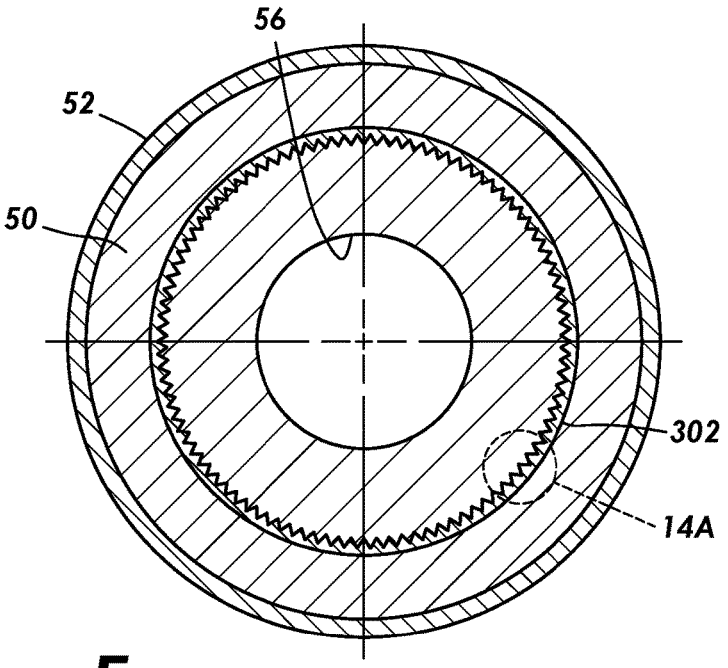
FIG. 14 is a schematic cross-section illustrating another embodiment of the invention and FIG. 14A is an enlarged view of a portion of FIG. 14.
Figure 14A:
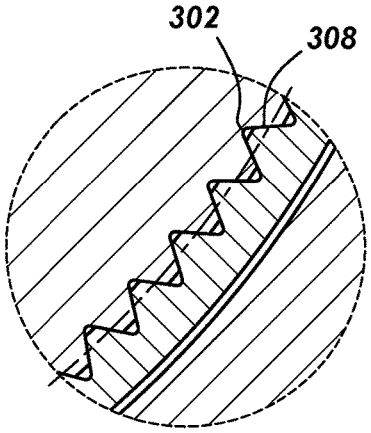

FIGS. 13 & 14 illustrate an exemplary area-altering modification of a contact surface. As illustrated in FIG. 13, the area of contact surface 301 of a common press fit is primarily a function of axial length and the two matching diameters 304, which is the inside diameter of housing 52, and 306, which is the outside diameter of a component 312 of the BHA of the connection. In contrast and as illustrated in FIG. 14, the area of contact surface 302 of a serrated connection is dependent on the axial length, the reference diameter and the number and shape of teeth 308 and their contact ratio factor.

Figure 15A:
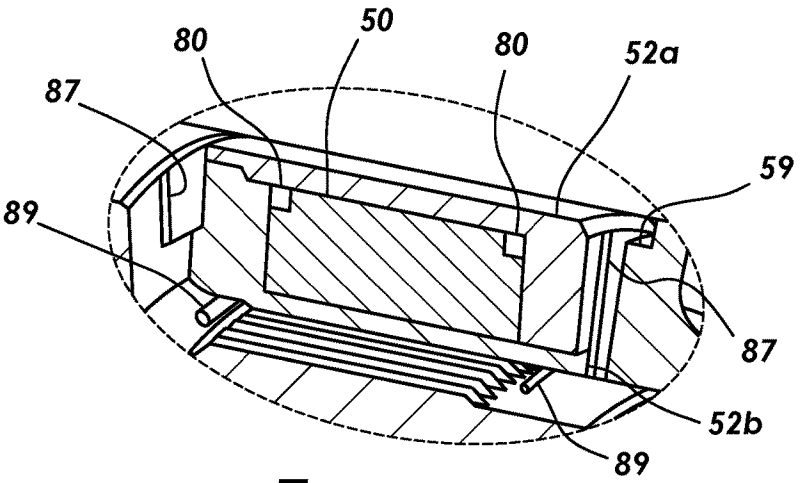
FIG. 15 is an isometric partial cutaway view of another embodiment of the invention and FIG. 15A is an enlarged view of a portion of FIG. 15.
Figure 15:
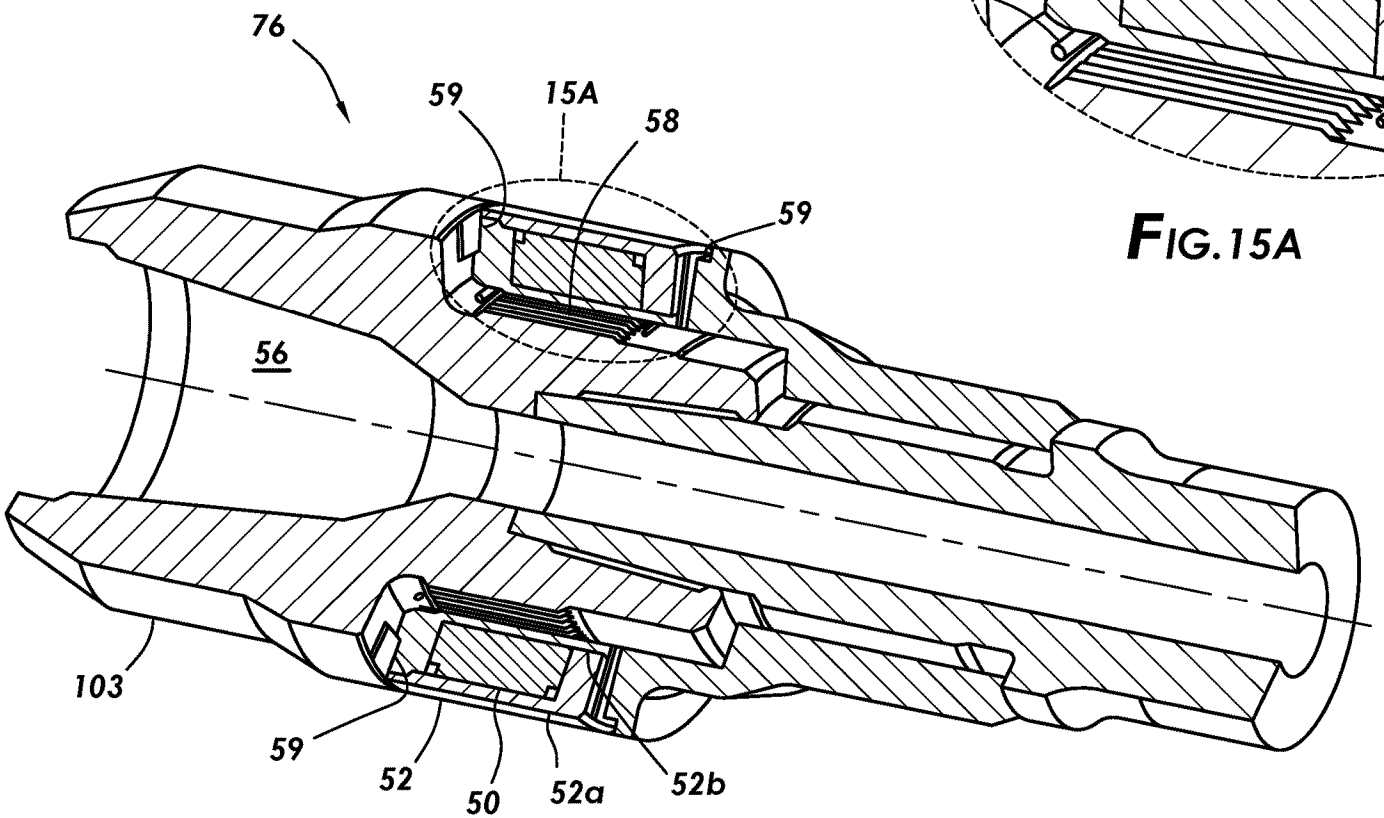

By way of example only, the interface between the damping device 10 and the component of the BHA 103 may include an area-altering feature such as the serrations 58 shown in FIG. 15. The interface may be substantially cylindrical, substantially planar, or may include both cylindrical and planar portions. In some embodiments, the interface may include a thermally conductive material (not shown). Alternatively or additionally, one or more of the gap(s) 59 between housing 52 and adjacent equipment (a component of the BHA 103 in the illustrated embodiment) may be filled with a thermally conductive material 87. Thermally conductive material 87 may comprise, a heat transfer coating, so as to enhance the conductance of heat away from housing 52 and create additional paths for conducting the generated heat into the ambient drilling fluid in the fluid passage between cylindrical outer surface of housing 52 and the wellbore wall.

Still referring to FIG. 15, if present, cartridge 76 may be mechanically coupled to a component of the BHA 103. In such case the mechanical coupling may define an interstitial volume, which interstitial volume may be sealed off, for instance by one or more common O-rings 89, or the like. Said interstitial volume may be filled with a thermally conductive material so as to enhance the conductance of this heat path. Furthermore, the reference diameter for the sealing at one side of the mechanical coupling may have a diameter different from the reference diameter for the sealing at the opposite side. Since the volume may be sealed off the environment in such case, the pressure of any fluid or thermally conductive material contained within the interstitial volume may be different from the ambient pressure. In such instances, the cartridge 76 may act as a differential piston having a pre-defined effective direction, enhancing yet another common form-locked and/or force-locked connection between one or more surfaces of the damping device 10 and the component of the BHA on which the damping device 10 is positioned (not illustrated). This mechanical coupling may also thermally couple damping device 10 to the component of the BHA, defining yet another additional thermal path for conveying and removing the generated heat.

Figure 16A:
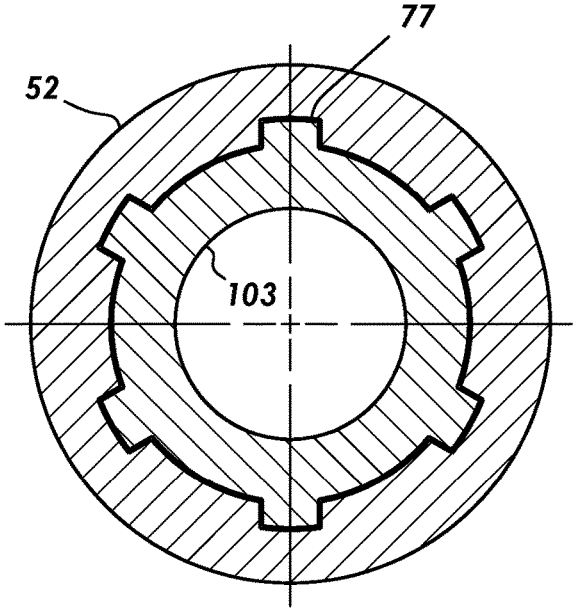
FIGS. 16A-D are cross sectional views of another embodiment of the invention
Figure 16B:
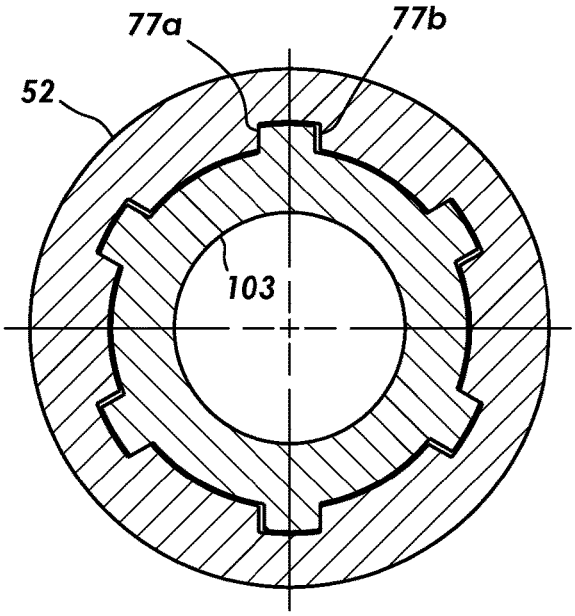
Figure 16C:
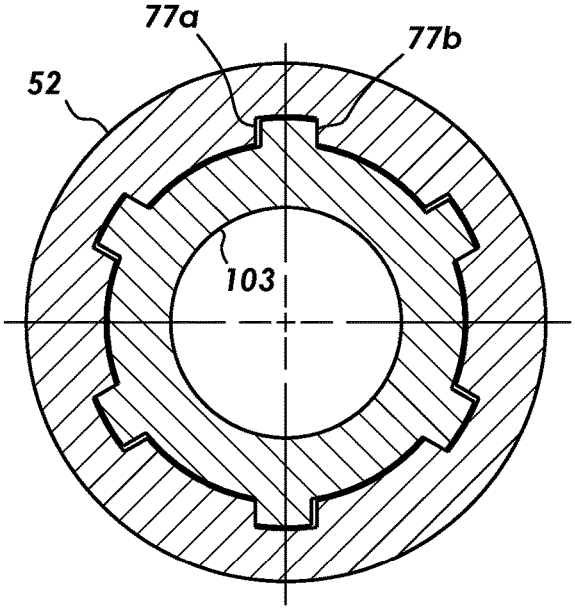
Figure 16D:
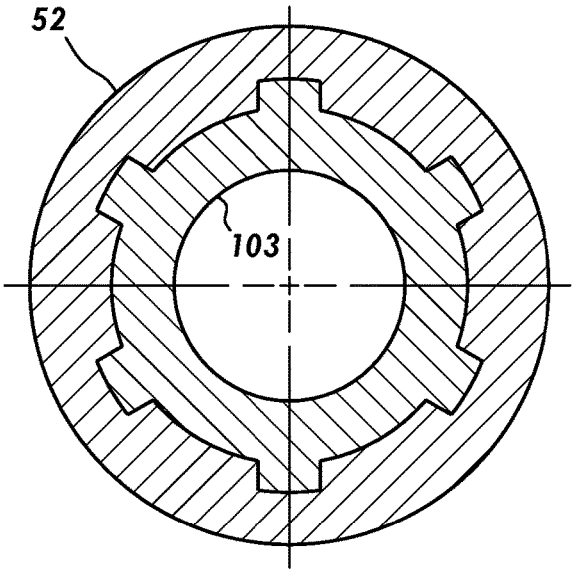

The transmission of heat away from damping device 10 is in addition to the mechanical function of the interface, which is to transmit torque (caused by rotational accelerations). If the interface is not sufficiently effective at transmitting torque, housing 52 would not rotate in phase with the BHA component 103. By way of example only, for a common force-locked connection, such as a press fit, as illustrated in FIG. 13, the effective transmitted torque is dependent on and limited by the contact pressure acting on the interface surfaces and the friction in between these surfaces. If the maximum transmittable torque value is exceeded, the housing 52 and the BHA component 103 may rotate relative to each other, i.e. both may not rotate in phase. Furthermore, depending on the coefficient of thermal expansion of the various components, a force-locked connection between mechanical components may not provide any contact pressure for particular ranges of environmental parameters, such as high and/or low temperatures. For a common form-locked connection, such as a spline shaft connection, any clearance within the connection as illustrated at 77 in FIG. 16A may cause the housing 52 to not rotate in phase with the BHA component 103 as long as the clearance between the form-locked feature(s) is not closed. At a single oriented rotational acceleration, as illustrated by FIG. 16B, a counterclockwise rotation of BHA component 103 relative to housing 52 may close clearance 77*a* on one side of the form-locked feature(s) so that the housing 52 will rotate counterclockwise (as drawn) in phase with the BHA component 103 after a time offset. In this case, the clearance 77*b* at the opposite side of the form-locked feature(s) would simultaneously be enlarged, as illustrated in FIG. 16B. Due to the damping device 10 overall inertia, a changed orientation of the rotational acceleration would close clearance 77*b* while opening clearance 77*a*, as illustrated by FIG. 16C, causing the housing 52 to also change its rotation orientation and to rotate clockwise in phase with the BHA component 103 after yet another time offset. Since the damping device 10 is supposed to be effective for both rotational directions, which may change at a higher frequency, any clearance 77 would cause the damping device 10 to lag BHA component 103 at every reversal of rotational direction. For an effective function of damping device 10, its housing 52 is required to rotate in phase with the BHA component 103 and therefor the clearance between such form-locked feature(s) is required to be minimized at the expected operation conditions, as illustrated in FIG. 16D. In some embodiments, the minimum clearance is the smallest clearance that achieves a predetermined amount of torque transmission in the expected operating temperature range.

Figure 17:
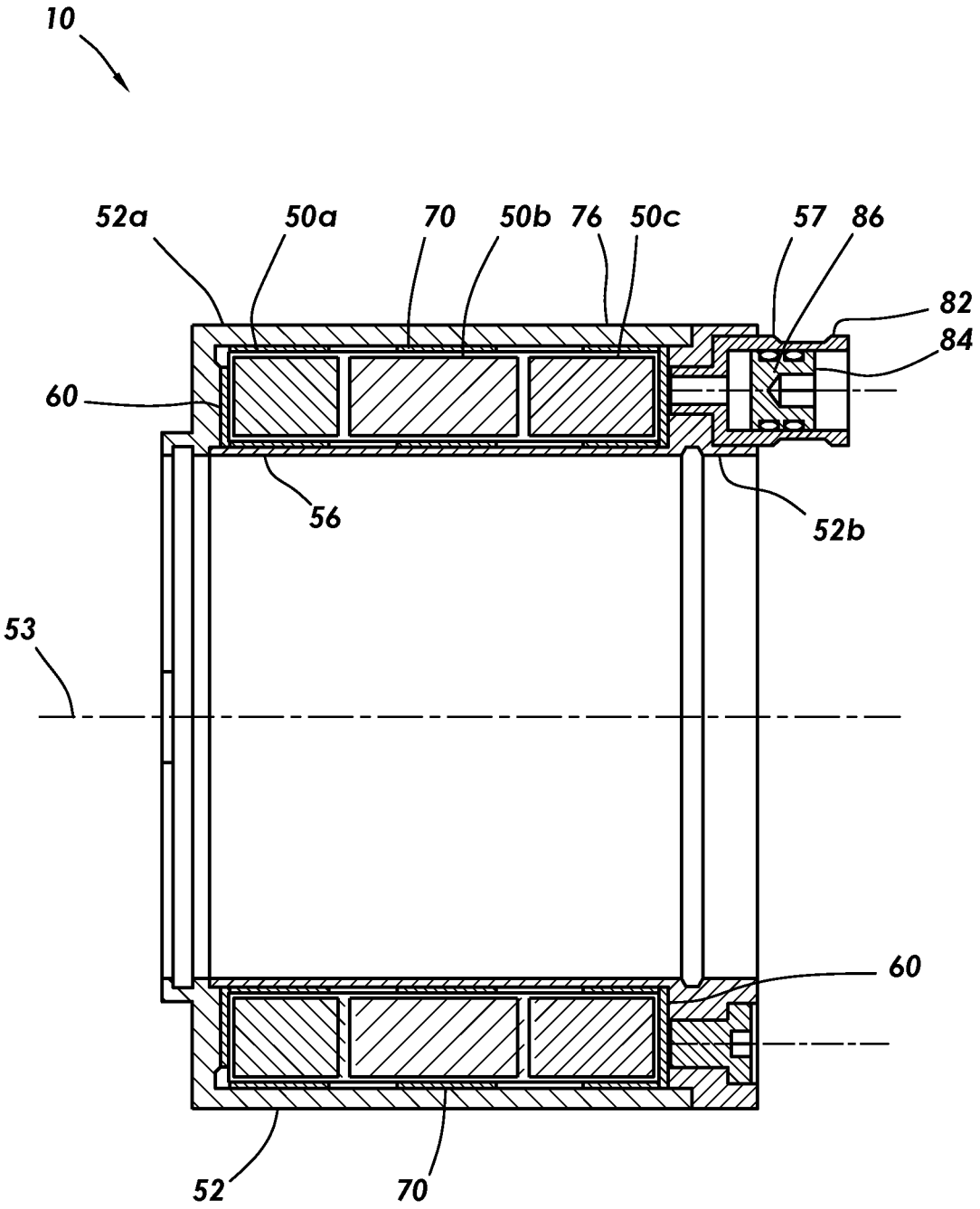
FIGS. 17-18 are cross-sectional and isometric partial cutaway views, respectively, of another embodiment of the invention.
Figure 18:
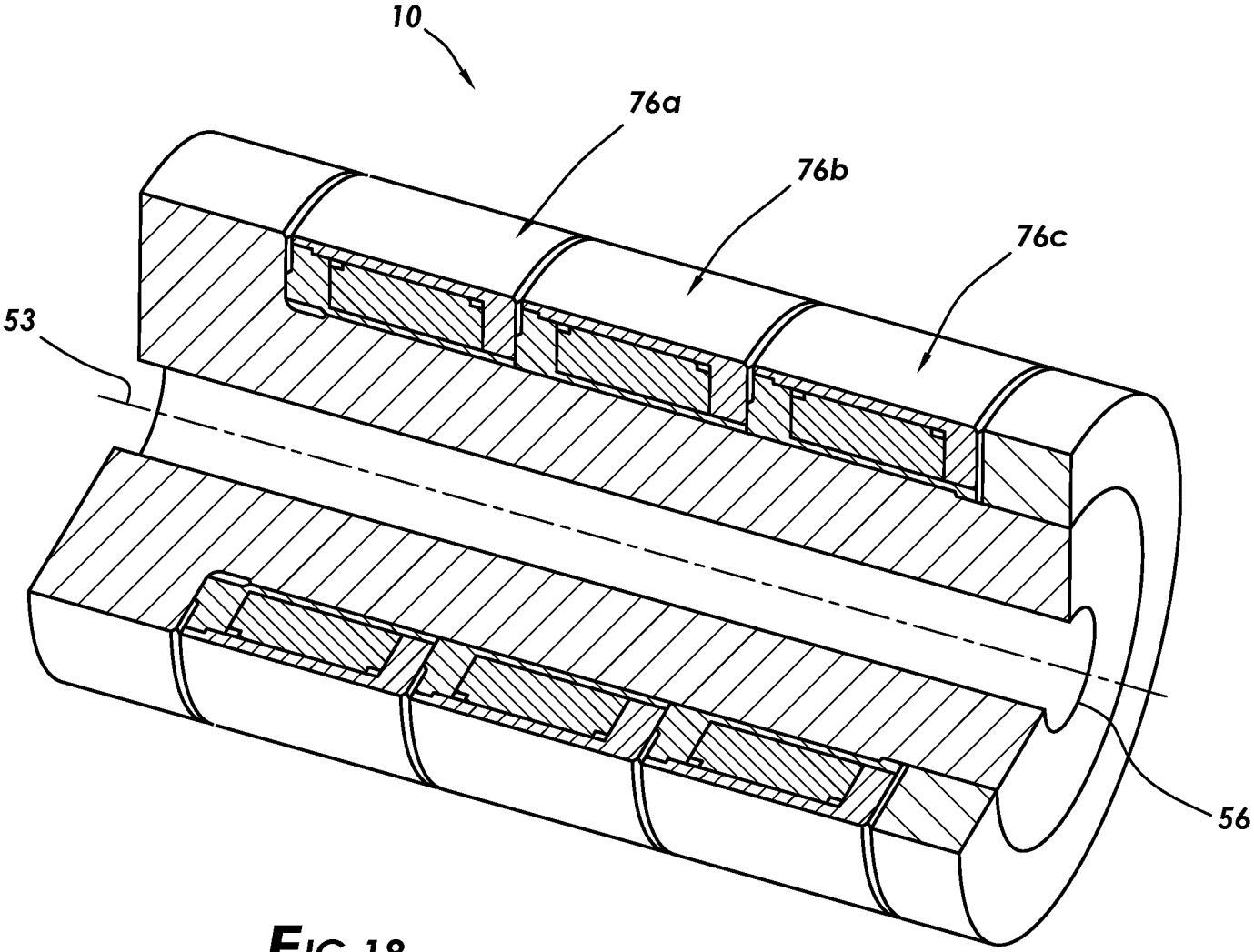

Referring briefly to FIGS. 17-18, in other embodiments, inertia element 50 may be provided as two or more individual inertia elements, such as those illustrated at 50*a*, 50*b*, and 50*c*. Individual inertia elements 50*a*, 50*b*, and 50*c* may be provided within a single cartridge 76, as shown in FIG. 11, or may be provided in separate cartridges 76*a*, 76*b*, 76*c*, as shown in FIG. 18. Inertia elements 50*a*, 50*b*, and 50*c* may differ in their individual inertias by i) having a different volume, ii) being made of materials having different densities, iii) having different moments of inertia, or a combination of these options. The housings of the separate cartridges 76*a*, 76*b*, 76*c* may also be made of materials having different mechanical and/or thermal properties, such as coefficient of thermal expansion (CTE). One or more of the separate cartridges 76*a*, 76*b*, 76*c* may also being coupled to the component of the BHA by different connection types and/or may also have separately adjusted thermal conductivities to account for the different operating points of the separate damping devices. The interfaces between the cartridge(s) and the BHA component may optionally include an insert comprising a thermally conductive material, as illustrated at 87 in FIG. 15. Furthermore, each of the individual inertia elements 50*a*, 50*b*, and 50*c* may be provided with its own bearing setup, and each of the individual inertia elements 50*a*, 50*b*, and 50*c* may maintain its specific circumferential gap.

Regardless of the configuration of the inertia element 50 and receptacle 54, in some embodiments the interstitial volume between inertia element 50 and receptacle 54 may be filled with a fluid. In such instances, the portion of receptacle 54 that is not occupied by inertia element 50 may be occupied by a specifically selected damping fluid, such as a viscous medium including, for example, silicone oil. The damping fluid may have a high viscosity, such as for example up to 1,000,000 cSt at 25° C. In some embodiments, housing 52 and/or a pressure compensation feature 57 may each include ports and channels (not shown) for evacuating or filling the pressure compensation feature 57 and the volume between housing 52 and inertia element 50 with damping fluid.

In still other embodiments, the portion of receptacle 54 that is not occupied by inertia element 50 may be occupied by an elastomer or one or more elastomeric bodies. The elastomer needs to have specific elastic and damping properties so that it can deform and dissipate energy while deforming. For both choices (a high viscosity fluid and an elastomer) it is required that the molecular chains of the material move relative to each other so as to dissipate energy. In addition, the elastomer is preferably attached to both the housing 52 and the inertia element 50 in order to transmit torque therebetween.

The presence of a viscous fluid or elastomer between the inertia element 50 and the housing 52 will result in internal friction whenever inertia element 50 moves relative to housing 52. The friction between inertia element 50 and housing 52 allows the transmission of torque from housing 52 to inertia element 50. Because fluid is a poor transmitter of force and the elastomer is preferably selected to be likewise an absorber of force, a portion of the force imparted by housing 52 will be converted to heat instead of being transmitted to inertia element 50. Thus, as vibrations and/or rotational accelerations are transmitted to housing 52, they will be resisted and damped by the action of the inertial element on the fluid.

Figure 19:
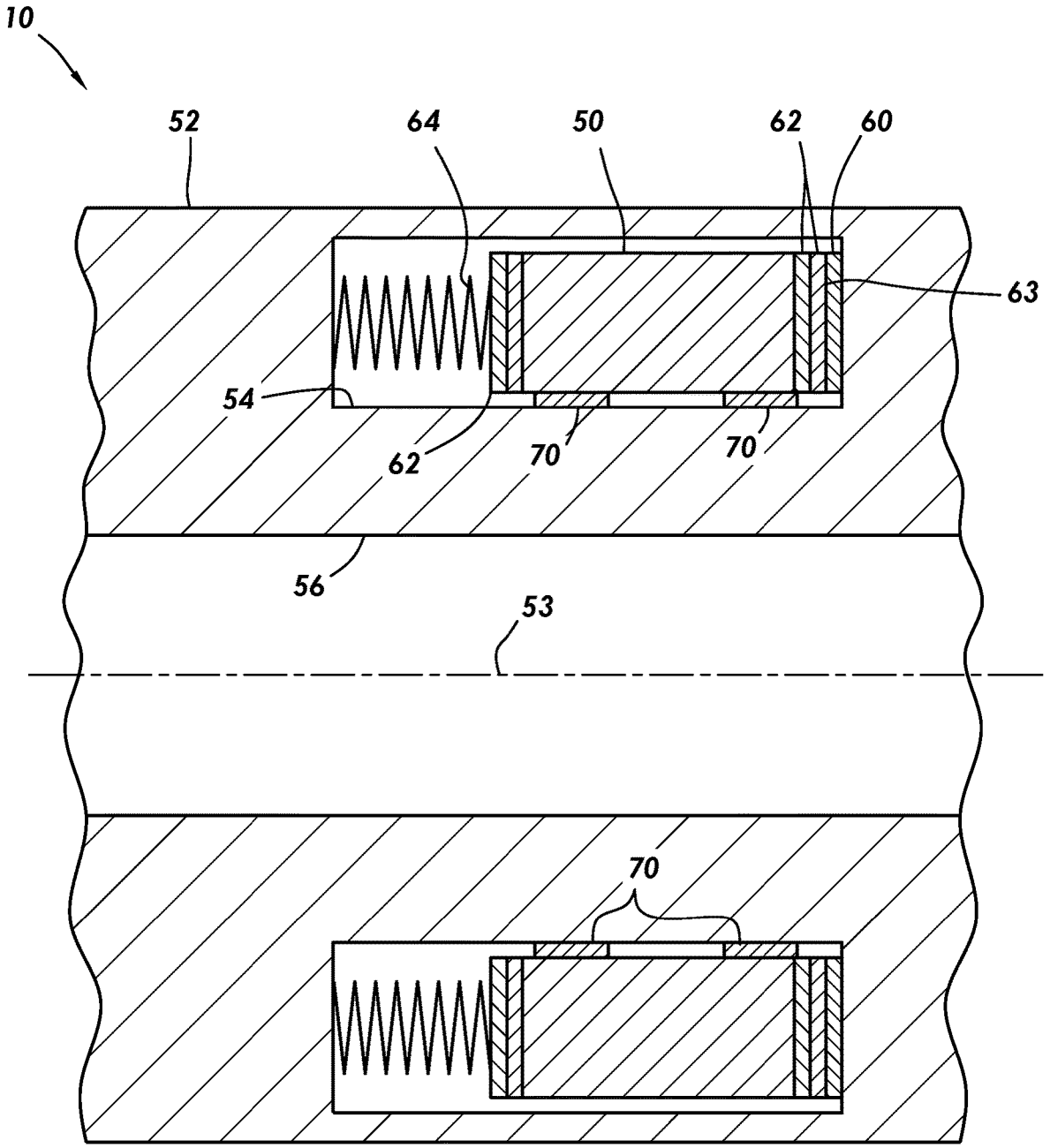
FIG. 19 is a schematic cross-section illustrating another embodiment of the invention.

By way of example only and referring to FIG. 19, alternatively or in addition to a damping fluid, damping device 10 may be equipped with one or more pairs of longitudinal friction pads 62 that act in conjunction with one or more longitudinal biasing means 64 and inertial element 50. In the illustrated embodiment, longitudinal biasing means 64 urges inertia element 50 toward one end of receptacle 54 and into engagement with longitudinal friction pad(s) 62. Longitudinal biasing means 64 and pairs of longitudinal friction pad(s) 62 may each be provided at either or both ends of inertia element 50.

Figure 20:
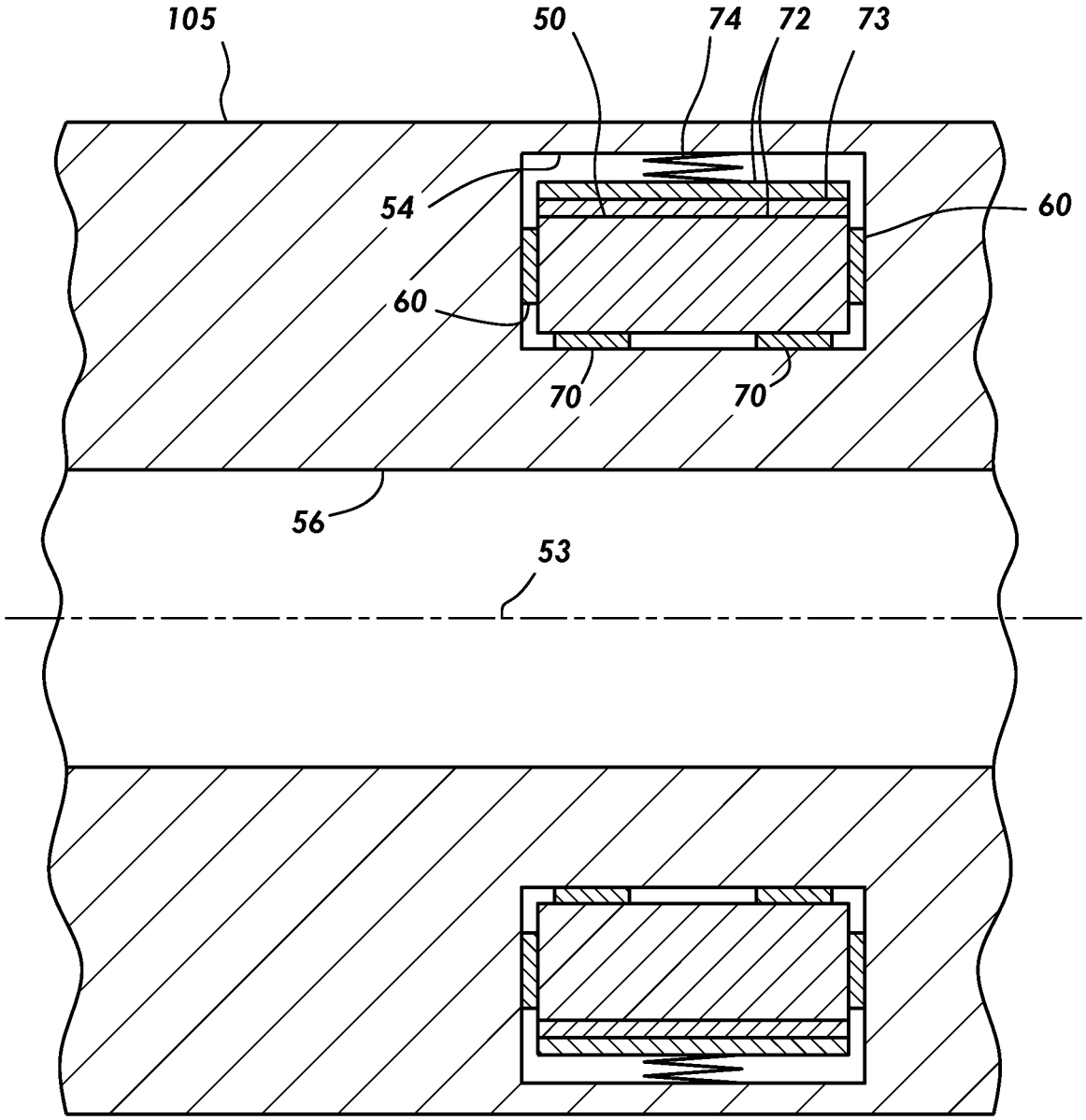
FIG. 20 is a schematic cross-section illustrating another embodiment of the invention.

Alternatively or in addition to longitudinal compression and friction, and referring to FIG. 20, damping device 10 may be equipped with one or more pairs of radial friction pads 72 that act in conjunction with one or more radial biasing means 74 and inertial element 50. Radial friction pads 72 may be radially inward and biasing means 74 may be radially outward of inertia element 50, as shown, or vice versa. One radial friction pad 72 may be affixed to biasing means 74 and a second radial friction pad 72 may be affixed to inertia element 50, so that when inertia element 50 rotates relative to housing 52, energy is dissipated as heat at the interface between the two friction pads.

Each pair of friction pads 62, 72 defines a pad interface 63, 73, respectively, therebetween. By way of example, as illustrated at the left-hand end of inertia element 50 (FIG. 19, as drawn), one longitudinal friction pad 62 may be affixed to longitudinal biasing means 64 and a second longitudinal friction pad 62 may be affixed to inertia element 50, so that when inertia element 50 rotates relative to housing 52, energy is dissipated as heat at the interface between the two friction pads. Friction pads 62, 72 may comprise any material or combination of materials that provides a desired coefficient of friction at pad interface 63 and can withstand the temperatures associated with the downhole environment and the intended dissipation of energy.

In embodiments that include friction pads, the energy dissipation depends, not on the medium in the interstitial volume, but on friction between individual friction pads 62, 72. Thus, in this embodiment, it is possible to replace the viscous damping fluid with any kind of fluid, even drilling mud. Thus, in certain embodiments, inertia element 50 does not need to be fully enclosed in housing 52 and receptacle 54, i.e. the volume in which inertia element 50 is housed, may be in fluid communication with either the outside or the inside (bore) of the drilling tool. By way of example, FIG. 9 illustrates an embodiment in which housing 52' is configured such that receptacle 54' is in fluid communication with bore 56 and FIG. 10 illustrates an embodiment in which housing 52" is configured such that receptacle 54" is in fluid communication with the environment outside of housing 52". In either case, longitudinal bearings, longitudinal friction pads, and longitudinal biasing means may optionally also be included in receptacle 54, along with radial bearings, as described above.

Referring again to FIGS. 2-7, a damping device 10 can be used to increase the reliability of an RSS and/or components of the RSS or BHA. Damping device 10 is especially advantageous in operations that have no designated vibration damping drill string component. Damping device 10 can be integrated into a drill string as a separate device, and/or as a separate device positioned within another drill string member (cartridge), or by integrating its components into a torque-transmitting member of the drill string.

In some embodiments, damping device 10 can be tuned to at least one rotational natural frequency of the tool or component it is intended to protect, which may include, for example, the BHA, RSS, or other components of the RSS. In these embodiments, the tool or component is modeled and its natural frequency(ies) is(are) calculated.

Figure 21:
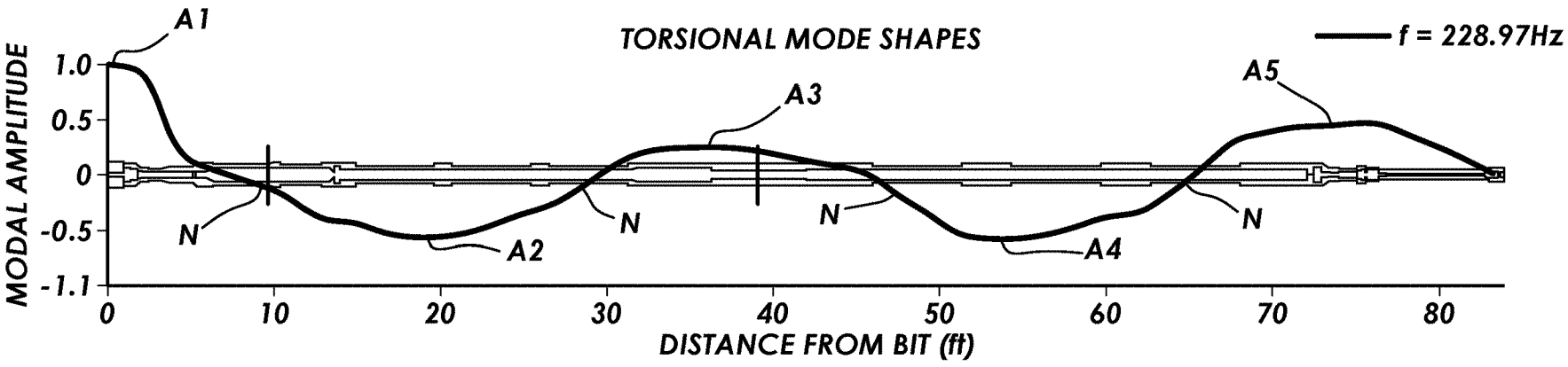
FIG. 21 is a schematic illustration of rotational vibrational nodes of part of a drill string.

According to some embodiments, damping device 10 can be adapted to a drill string or component thereof using the following steps:

a) Calculate the rotational natural frequencies, also referred to as Eigen Values or eigenfrequencies, and mode shapes (Eigen Vectors) based on the mechanical properties of the BHA (ODs, IDs, Lengths, and Material Properties). The calculation may be based on a finite elements analysis (FEA) or the like. Boundary conditions may be selected such that the system being examined is free to rotate at one end and can be fixed, free, or weakly supported at the opposite end.

b) Tune the damping device characteristics to match the desired frequencies. Each damping device 10 will have frequency dependent damping properties; tuning entails adjusting the frequency dependent damping properties of the device to correspond to the at least one desired frequency. The frequency dependent damping properties can be adjusted by adjusting one or more parameters including the inertia (mass, material density, lever to axis of rotation, etc.) and damping characteristics (type of fluid, fluid viscosity, shear gap width, shear gap length, coefficient of friction, preload, etc.) of the damping device. In some instances, the target frequency may be from 30 Hz up to 1000 Hz. The tuning may be carried out empirically or using mathematical models.

c) Use the calculated mode shapes to select a location for the damping device. As illustrated schematically in FIG. 21, for a given tool and frequency, a mathematical model can be used to calculate the amplitude of vibration at each point along the tool. As illustrated in FIG. 21, the amplitude will tend to vary between antinodes A1, A2, A3 . . . , i.e. points along the Eigen Vector in which the amplitude is a local maximum or minimum, along the length of the tool, with a node N (zero value) between each pair of adjacent antinodes. Depending on the tool, the antinodes may increase or diminish in amplitude along the length of the tool, with the greatest amplitude (greatest maximum) being closest to one end of the tool.

d) Use the calculation to determine the vibration energy being converted into heat energy at the desired frequency, i.e. at its intended operating point, considering i) said frequency-dependent damping properties and characteristics of the damping device itself; ii) the temperature dependent mechanical properties (Young's Modulus, Yield Strength, etc.) and thermal properties (coefficient of thermal expansion, thermal conductivity, etc.) of the materials housing 52 and the component of the BHA are made of; and iii) the mechanical and thermal properties of the mechanical coupling (contact surface, contact pressure, thermal conductivity, etc.). The path for the into heat converted energy may change depending on material properties and/or properties of the mechanical coupling, therefore the calculation may include one or more iteration steps.

Figure 22A:
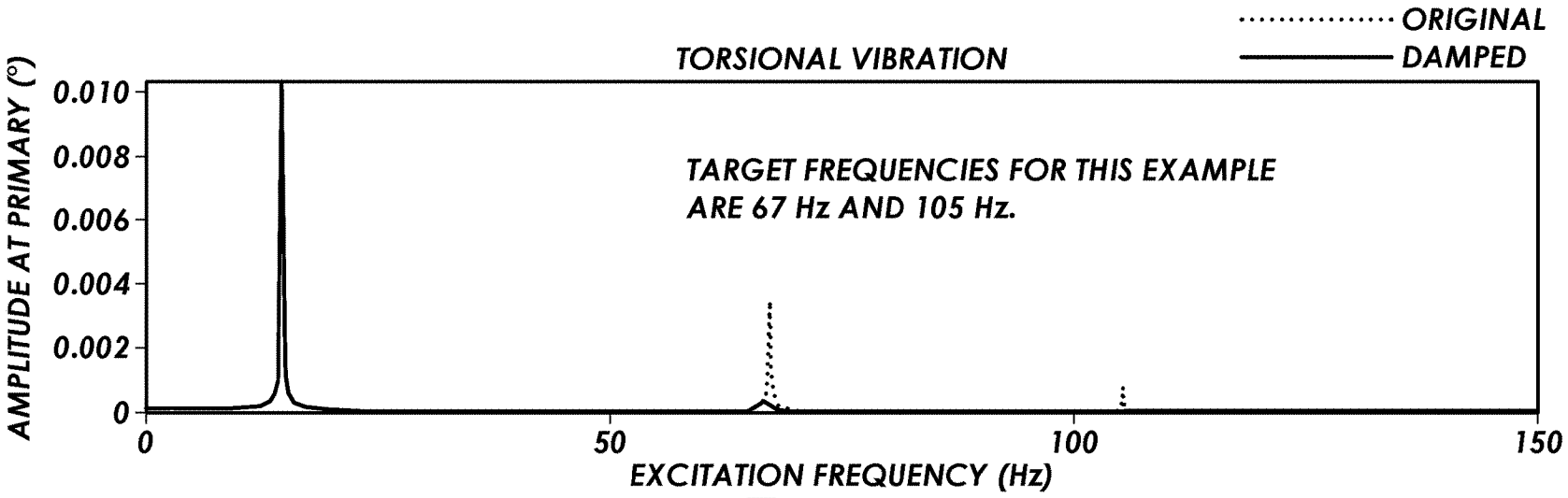
FIGS. 22A and 22B are plots of models illustrating damping of rotational vibration at target frequencies.
Figure 22B:
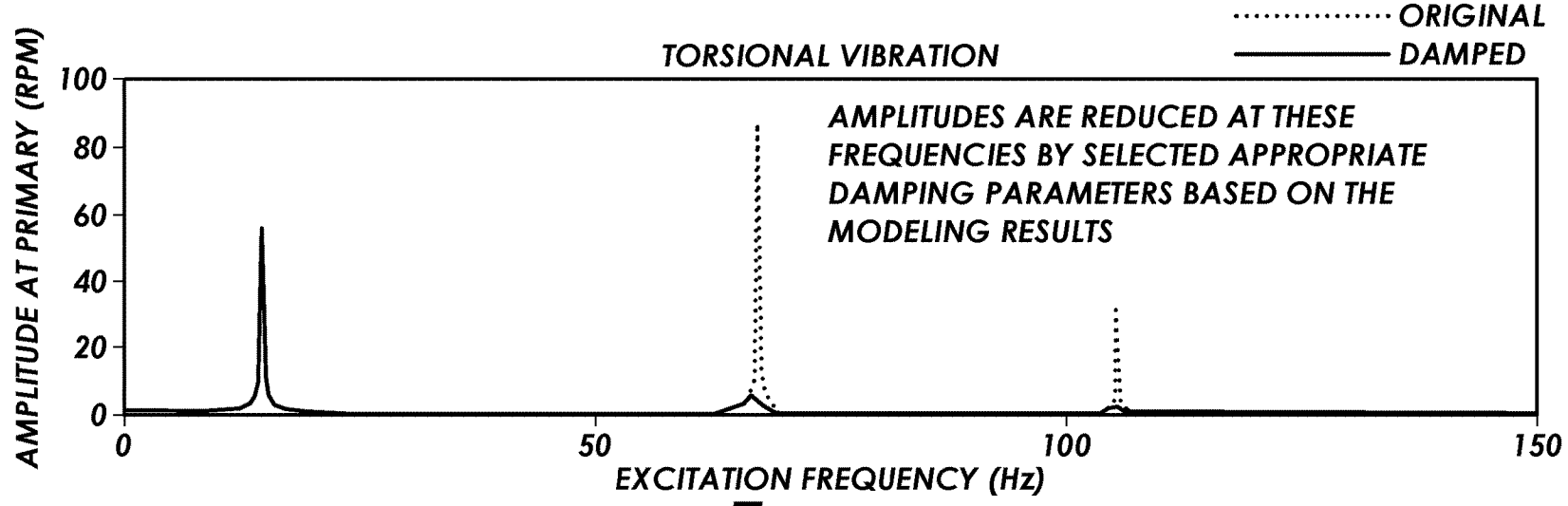

In some embodiments, it may be advantageous to position a damping device 10 at each of one or more anti-nodes. In some instances, it may be desirable to position a damping device 10 close to or at the point with the largest absolute value of modal displacement. FIG. 22 illustrates damping of rotational vibration measured in degrees (FIG. 22A) and rpm (FIG. 22B).

A system including one or more damping devices may be configured to damp vibrations at one or more frequencies. In some embodiments, damping devices tuned to different frequencies can be used to damp multiple (separate) frequencies. In other embodiments, a single damping device that is capable of damping a broad range of frequencies can be used. The effective frequency range of a damping device can be influenced by various parameters, as set out above.

Figure 23:
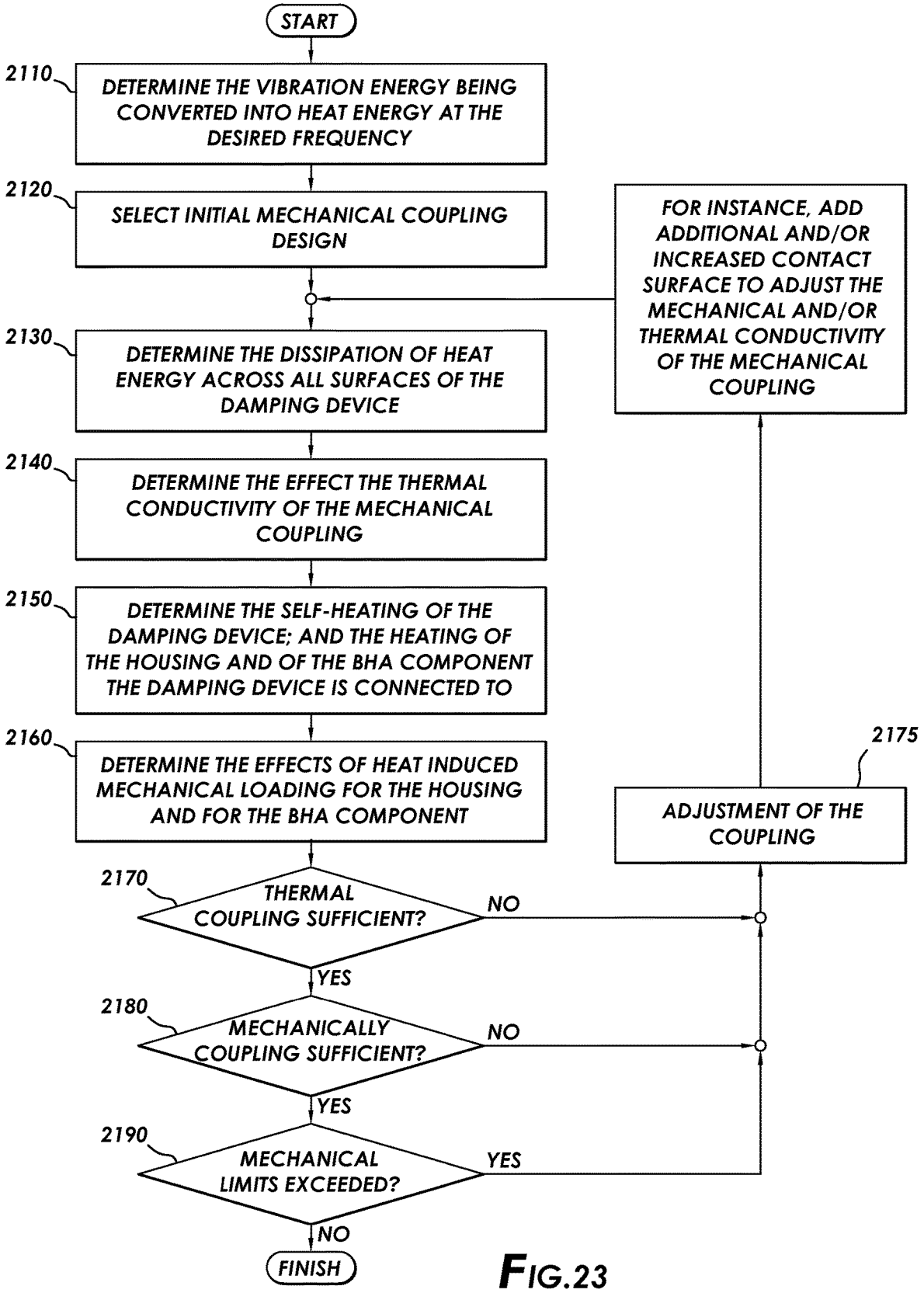
FIG. 23 is a flow chart illustrating the iterative process of configuring the mechanical coupling of the invention.

In some embodiments, as illustrated in FIG. 23, step d) may include optimization of the thermal contact between damping device 10 and the downhole tool so as to increase the thermal conductivity of the mechanical coupling. Specifically, an iterative method for optimizing heat dissipation may include the steps of: 2110 determining the vibration energy being converted into heat at the desired frequency, 2120 selecting an initial mechanical coupling design, 2130 determining the rate of heat dissipation across all surfaces of the damping device, 2140 determining the effect of the thermal conductivity of the mechanical coupling, 2150 determining the self-heating of the damping device and the associated heating of the housing and the BHA component to which the damping device is connected, and 2160 determining the effects of heat-induced mechanical loading for the housing and the BHA component. In step 2170 the calculated rate of heat generation may be compared to the rate of heat loss to determine whether the thermal coupling is sufficient. If the thermal coupling is not sufficient, the thermal conductivity of the mechanical coupling may be adjusted at step 2175 and the calculation of steps 2130-2160 may be repeated. If the thermal coupling is deemed sufficient in step 2170, the sufficiency of the mechanical coupling is determined in step 2180. If the mechanical coupling is not sufficient, the mechanical coupling may be adjusted at step 2175 and the calculation of steps 2130-2160 may be repeated. If the mechanical coupling is deemed sufficient in step 2180, a calculation may be made in step 2190 to determine whether the mechanical limits of the device have been exceeded. If the mechanical limits have been exceeded, the mechanical coupling may be adjusted at step 2175 and the calculation of steps 2130-2160 may be repeated. If the mechanical limits are not exceeded, the tool design step may be completed.

The above-described optimization may take place during the design phase of the tool. In some embodiments, the optimization may take into account the range of BHA configurations and a range of damping device configurations, including but not limited to target frequency, position along the BHA. In some instances, the optimum may represent a certain range covering relatively small variations of damping device setups.

An example of the mechanical result of such optimization is illustrated in FIGS. 13 and 14. The interface between the damping device 10 and the component of the BHA 103 is altered by introducing an area-altering feature, in this case a serration, to increase the surface area at which the components are in direct contact, compared to an initial press fit connection. Thereby more heat energy may be dissipated along this path. In this case, the damping device itself may not heat up as in the previous contact surface design but the housing of the damping device and/or the downhole tool may heat up and expand differently from the previous contact surface design. Dependent on the respective thermal properties (coefficient of thermal expansion) of the downhole tool and the damping device, the heat induced mechanical loading and consequently internal stress of the damping device and/or the downhole tool may change; and said change may affect the thermal conductivity of the mechanical coupling, which defines the amount of heat energy dissipating via the mechanical coupling.

By way of example only, during operations, the damper may be expected to reach an equilibrium temperature at which the heat generated by internal friction is balanced by the cooling provided by the passing drilling fluid. The dimensions of the damping device housing 52 and the adjacent BHA component(s) will change to each material's coefficient of thermal expansion (CTE). If the materials' CTEs are different, the mechanical interface between the damping device housing 52 and the adjacent BHA component(s) will also change. For example, if the shaft expands a little more than the hub, the contact pressure of a press fit would increase. In one embodiment, the materials may be selected to have a CTE ratio such that the assembly of the two parts could easily be done at room temperature (loose fit) but at the operating point the different thermal expansion would cause a press fit sufficient to ensure the required torque transmission. Likewise, in some embodiments, if present, cartridge 76 may be configured to be easily removed or replaced because of a certain clearance in the mechanical coupling at a common ambient temperature, and/or cartridge configured to be affixed to the downhole tool by having, for instance, a particular contact pressure acting on the contacting surfaces of the mechanical coupling in between damping device and downhole tool. In some embodiments, it may be advantageous to configure the device components such that the clearance between the damping device housing 52 and the adjacent BHA component(s) is the smallest clearance that achieves a predetermined amount of torque transmission in the expected operating temperature range.

The purpose of the present damping device is to protect the BHA, or certain parts of said BHA, from rotational vibrations that exceed detrimental magnitudes. In some instances, the device may be used for damping loads that occur during drilling operation, such as torque peaks and/or rotational accelerations/oscillations. A drilling system may include one or a plurality of said damping devices in different locations. The damping device can be an integral part of the BHA or one of its components, where all needed elements are integrated into readily available tools. It can also be added to the BHA as a separate device (module), where all elements are integrated into a tool on its own.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art may readily use the present disclosure as a basis for designing or modifying other processes and structures for carrying out the same purposes and/or achieving the same advantages of the embodiments introduced herein. One of ordinary skill in the art may make various changes, substitutions, and alterations without departing from the scope of the present disclosure.

What is claimed is:

1. A damping device for use with a downhole tool, the downhole tool having a tool axis and an expected operational temperature range, the damping device comprising:

a device housing mechanically coupled to the downhole tool, wherein the device housing includes a receptacle having a volume; and an inertia element movably supported in the receptacle and having a volume, a mass, and a non-zero moment of inertia about the tool axis;

wherein the inertia element is supported within the receptacle in a manner that allows the inertia element to move relative to the device housing; and wherein an interface is defined between the device housing and the downhole tool, wherein the interface is disposed between the inertia element and the tool axis and wherein the interface includes an area-altering feature.

2. The device of claim 1 wherein the volume of the inertia element is less than the volume of the receptacle so that an interstitial volume is defined between the inertia element and the receptacle, and wherein the interstitial volume is occupied by a fluid or an elastomer.

3. The device of claim 1 wherein the device housing includes an area-altering feature that is configured to correspond to and align with a feature on the downhole tool so as to maximize thermal contact therebetween.

4. The device of claim 1 wherein the device housing has a coefficient of thermal expansion such that at the expected operational temperature range the interface has an operational coefficient of static friction sufficient to transmit a predetermined amount of torque and a predetermined amount heat flow across the interface.

5. The device of claim 1 wherein the interface includes a thermally conductive material in thermal contact with the device housing and the downhole tool.

6. The device of claim 1 wherein the interface is cylindrical.

7. The device of claim 1 wherein the interface is planar.

8. The device of claim 1 wherein the interface includes a cylindrical portion and a planar portion.

9. A damping device for use with a downhole tool, the downhole tool having a tool axis and an expected operational temperature range, the damping device comprising:

a device housing mechanically coupled to the downhole tool, wherein the device housing includes a receptacle having a volume; and an inertia element movably supported in the receptacle and having a volume, a mass, and a non-zero moment of inertia about the tool axis;

wherein the inertia element is supported within the receptacle in a manner that allows the inertia element to move relative to the device housing;

wherein an interface is defined between the device housing and the downhole tool, wherein the interface includes an area-altering feature, and wherein the area-altering feature is selected from the group consisting of dimples, pleats, serrations, and fins.

10. A method for providing a tool for use with a bottom-hole assembly (BHA), the tool including a damping device and the damping device including an inertia element and a damping fluid in contact with the inertia element, the damping device mechanically coupled to and defining a clearance with an adjacent member, the method comprising the steps of:

a) calculating a set of natural frequencies and mode shapes for the BHA based on the mechanical properties of the BHA;

b) selecting at least one desired frequency from the calculated natural frequencies;

c) calculating or measuring the frequency-dependent damping response of the damping device and adjusting at least one property of the damping device so that the calculated or measured frequency-dependent damping response corresponds to the at least one desired frequency;

d) using the calculated mode shapes to determine where to couple the damping device to the BHA; and e) using the calculated frequency-dependent damping response to configure the damping device such that the clearance is the smallest clearance that achieves a predetermined amount of torque transmission at an expected operational temperature range.

11. The method of claim 10 wherein at an expected operational temperature within the expected operational temperature range a friction interface exists between the damping device and the adjacent member, and wherein step e) includes configuring the damping device such that the friction interface has a predetermined operational coefficient of static friction at the expected operational temperature.

12. A method for optimizing a downhole damping device for use with a bottom hole assembly (BHA), the damping device having a longitudinal axis and including an inertia element and a damping fluid or elastomer in contact with the inertia element, the damping device being mechanically coupled to the bottom hole assembly (BHA) and defining at least one mechanical interface therewith, the method comprising the steps of:

a) calculating a set of natural frequencies and mode shapes for the BHA based on the mechanical properties of the BHA;

b) selecting at least one desired frequency from the calculated natural frequencies;

c) calculating or measuring the frequency-dependent damping response of the damping device and adjusting at least one property of the damping device so that the calculated or measured frequency-dependent damping response corresponds to the at least one desired frequency;

d) using the calculated mode shapes to determine where to couple the damping device to the BHA; and e) using the calculated frequency-dependent damping response to configure the damping device such that an expected operational temperature range the mechanical interface has a predetermined coefficient of static friction.

* * * * *